US009271562B2

(12) United States Patent
Elias

(10) Patent No.: US 9,271,562 B2
(45) Date of Patent: Mar. 1, 2016

(54) RETRACTABLE HAIRBRUSH SYSTEM

(71) Applicant: Steve Elias, San Francisco, CA (US)

(72) Inventor: Steve Elias, San Francisco, CA (US)

(73) Assignee: Steve Elias, Honolulu, HI (US)

( * ) Notice: Subject to any disclaimer, the term of this patent is extended or adjusted under 35 U.S.C. 154(b) by 99 days.

(21) Appl. No.: 14/243,880

(22) Filed: Apr. 2, 2014

(65) Prior Publication Data

US 2015/0282602 A1 Oct. 8, 2015

(51) Int. Cl.

| | |
|---|---|
| ***A46B 5/00*** | (2006.01) |
| ***A46B 7/04*** | (2006.01) |
| ***A46B 9/02*** | (2006.01) |
| ***A46B 15/00*** | (2006.01) |
| ***B65D 25/10*** | (2006.01) |

(52) U.S. Cl.

CPC ..... *A46B 7/044* (2013.01); *A46B 9/023* (2013.01); *A46B 15/0091* (2013.01); *B65D 25/108* (2013.01); *A46B 2200/104* (2013.01)

(58) Field of Classification Search

CPC ..... A46B 5/005; A46B 5/00
USPC ..... 15/144.1, 144.3, 144.4, 184; 206/581
See application file for complete search history.

(56) References Cited

U.S. PATENT DOCUMENTS

| | | | | | |
|---|---|---|---|---|---|
| 1,406,841 | A * | 2/1922 | Foss | A46B 17/02 | 15/144.4 |
| 1,501,547 | A * | 7/1924 | Bassett | A45D 33/36 | 15/106 |
| 2,184,827 | A * | 12/1939 | Willmot | A46B 15/0055 | 132/121 |
| 3,059,259 | A * | 10/1962 | Goldfarb | A46B 9/00 | 119/628 |
| 4,567,905 | A * | 2/1986 | Stewart | A45D 1/18 | 132/212 |
| 6,631,831 | B1 * | 10/2003 | Loiselle | A46B 17/06 | 132/119 |
| 7,047,587 | B2 * | 5/2006 | Heidel | A47L 25/005 | 15/104.002 |
| 2001/0001887 | A1 * | 5/2001 | Bigio | A46B 9/023 | 15/159.1 |
| 2010/0011525 | A1 * | 1/2010 | Habrle | A46B 5/0033 | 15/114 |

* cited by examiner

*Primary Examiner* — Steven A. Reynolds
*Assistant Examiner* — King M Chu
(74) *Attorney, Agent, or Firm* — Aroplex Law

(57) ABSTRACT

The new hairbrush system employs a handle made of curved rods that collapse into the body of the brush via tracks, turning it into a non-electric hair roller for setting and smoothing hair. The barrel of the brush system has curved bristles that grip hair and curved slits that allow for airflow. The carbon fiber (or equivalent) body provides for a lightweight yet sturdy tool that can effectively be used as a brush (without collapsed handle) when not being used as a roller (with collapsed handle).

3 Claims, 4 Drawing Sheets

FIG. 7A
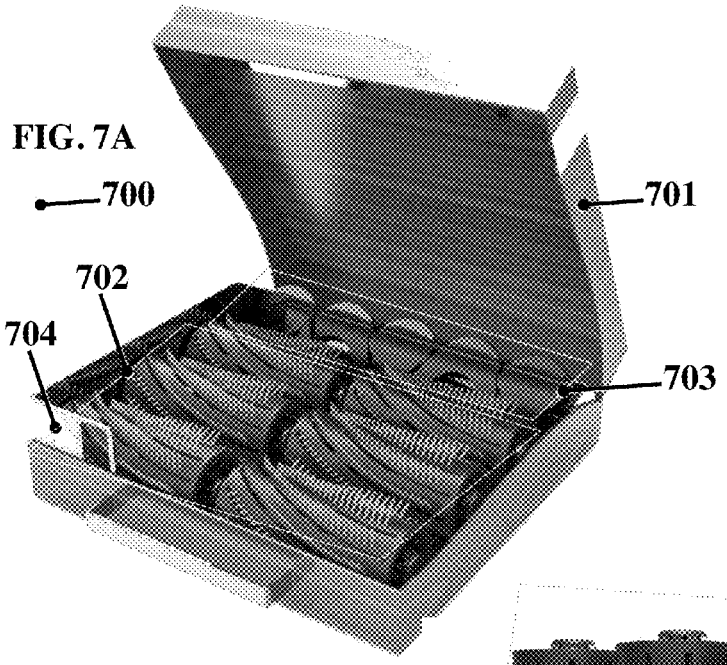
FIG. 7B
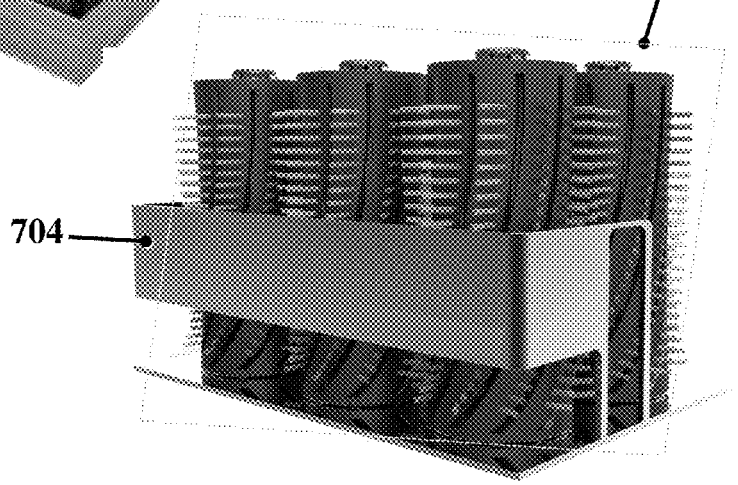
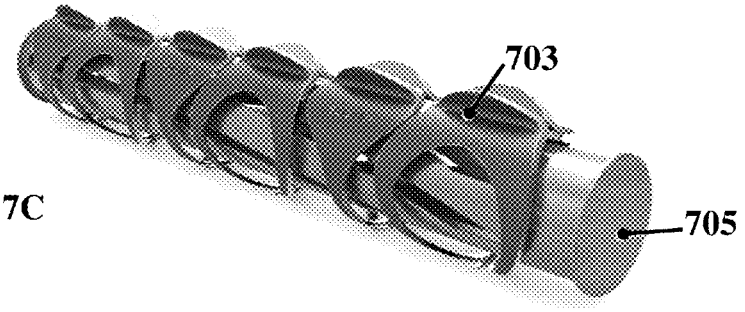
FIG. 7C

RETRACTABLE HAIRBRUSH SYSTEM

FEDERALLY-SPONSORED RESEARCH

None.

SEQUENCE LISTING

None.

BACKGROUND OF THE INVENTION

The present invention relates, generally, to the field of hairbrushes, and, specifically, to hairbrushes having collapsible, retractable handles that enable use of a single tool for all stages of styling. It is known that hairbrushes are an essential and ubiquitous tool in hair care and styling. It is also known that ceramic brushes and rollers are extremely effective in smoothing and styling hair. However, it has not been possible for personal users and stylists to seamlessly brush, dry and set hair into rollers without interference from projecting handles or the hassle and risk of loss in managing removable handles. The new hairbrush system functions differently in comparison to a standard round brush, round brush with removable handle, or standard curler.

Hairbrushes having removable or repositionable handles exist for personal use, as well as by professionals, and are generally designed to better enable ease of use with one's right or left hand (as disclosed in U.S. patent Ser. No. 12/460,388, Hair Brush With Slideable Brush Head) and are not designed with additional necessary features to enable use of the barrel as a roller.

There also exist various types of "compact" or "compactable" hairbrushes, such as those designed for convenience of transportation in one's purse. These designs generally include a mechanism for bristle retraction (such as that disclosed in U.S. patent Ser. No. 12/419,613, Hair Brush With Retractable Bristles) or for another form of bristle protection (such as that disclosed in U.S. patent Ser. No. 07/425,337). These are unrelated to the present invention and do not serve or attempt to serve the purpose of enabling one to seamlessly brush, dry and set hair into rollers.

SUMMARY OF THE INVENTION

Generally, this application relates to a complete series of hairbrushes, custom clips, salon station stand and compact travel case for the salon stylist to quickly and efficiently style a client's hair. While the system is targeted toward salon use, it can be used by individuals as well.

The preferred embodiment of the new retractable hairbrush system employs a handle made of curved rods that collapse into the barrel of the brush along tracks, thereby turning the body of the brush into a non-electric hair roller for setting and smoothing hair. The new system can use curved bristles for better independent hair "grippability" or straight bristles either on their own or in conjunction with a securing means, such as a wishbone clip that holds the hair-wrapped body of the hairbrush system in place. Hair drying is expedited by airflow through the hollow the body and vents of the hairbrush barrel, and its ceramic body allows for optimized heat retention and distribution. Tourmaline coating on bristles made of nylon and boar hair (real and synthetic) promotes hair smoothing.

The new hairbrush system is unique in the following respects:

- The new system uniquely facilitates styling like a standard round-barreled brush but enables setting similar to curlers;
- Industry-standard, ceramic barrels are not currently available in this type of application, only as stand-alone round brushes;
- The ceramic body conducts heat better and retains its heat longer than regular wood, plastic or metal brushes for a much stronger and more resilient hair set than conventional rollers provide;
- The hollow interior allows for maximum airflow through the brush barrel, making the brush lightweight and efficient while reducing dry time.
- The new system facilitates making the hair smoother and shinier when styling for an overall more for touchable and pleasing look;
- The new hairbrush system minimizes hair breakage due to heat or over-tension on the hair, unlike irons.
- The waving bristles and body barrel smooth out the hair while providing maximum grip to prevent slippage allowing for more tension in the hair;
- Tourmaline-charged ion bristles speed up hair drying time while providing shine and luster to the hair without creating static;
- A removable cap at the end of the brush allows easy clean-up of unwanted product or water that enters the hollow interior;
- The new retractable hairbrush pairs with custom designed "wishbone clips" for added support without the hair "drag" or unwanted indentation left by other styles of roller clips;
- The brush system can be used to straighten, curl, wave hair or create an array of hairstyles; and
- The retractable handle design allows for fast setting of hair of any length.

The sum of these advantages unify with the novel article of the new retractable brush system, resulting in an invention that is not anticipated, rendered obvious, suggested, or even implied by any of the prior art support, either alone or in any combination thereof.

These, together with other objects of the invention, along with the various features of novelty characterizing the invention, are described with particularity in the claims herewith. A more comprehensive understanding of the features, operation and uses of the invention may be gleaned from reference to the enclosed drawings and descriptive matter further illustrating the preferred embodiments of the invention.

The embodiments described herein are illustrative of the invention, and it is to be understood that the invention is not limited in its application to the details of construction and to the arrangements of the components set forth in the following description and drawings. The invention is capable of other embodiments and of being practiced and carried out in various ways. It should be further understood that the phraseology and terminology applied herein merely serve the purpose of description and should not be regarded as limiting.

BRIEF DESCRIPTION OF THE DRAWING(S)

FIGS. 6A-E collectively illustrate the structure and function of one embodiment of the wishbone clip.

FIGS. 7A-C collectively illustrate one embodiment of the functional storage case containing six retractable hairbrushes, six wishbone clips and a studio stand for the new hairbrush system.

DETAILED DESCRIPTION OF THE DRAWINGS

In accordance with this invention, it is now possible for personal users and stylists to seamlessly brush, dry and set hair into rollers without interference from projecting handles or the hassle and risk of loss in managing removable handles and all while providing industry-quality styling. The following is submitted to illustrate but not to limit this invention.

Figure 1:
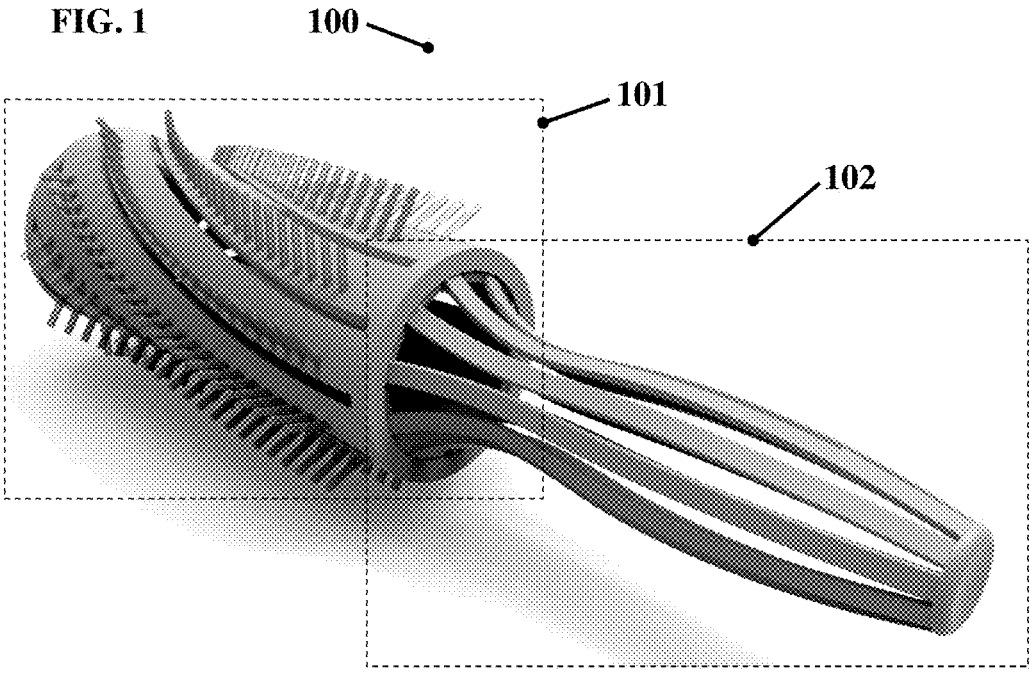
FIG. 1 depicts a perspective view of one embodiment of the retractable hairbrush system in "brushing" position.

FIG. 1 illustrates one embodiment of the new retractable hairbrush system 100 in brushing position with the handle 102 fully extending from the body 101

Figure 2:
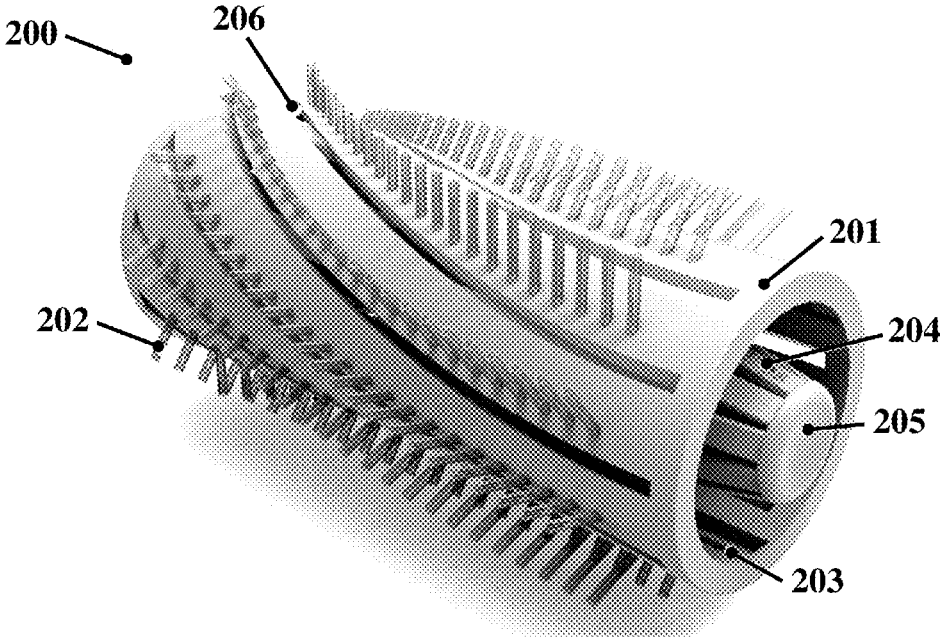
FIG. 2 depicts a perspective view of one embodiment of the retractable hairbrush system in "curling" position.

FIG. 2 illustrates one embodiment of the new retractable hairbrush system 200 in rolling position with the handle fully retracted into the brush body. The brush body is comprised of a barrel 201 having slits 206 to enable airflow and bristles 202 attached perpendicularly to the barrel 201. The body also has tracks 203 running generally longitudinally along the inner surface of the barrel 201. As shown, the handle, being fully retracted into the body, is composed as a multiplicity of rods 204 connected at the distal end by a solid cap 205.

The new retractable brush system's primary mechanism works by retracting (collapsing) the handle into the body of the brush thereby allowing a user to place several brushes on the head in roller position without the handle impeding results. When the handle rods are squeezed, they ends are allowed to slide into the body along tracks on the inner surface of the barrel. This prevents the handle from moving until the user deliberately causes the handle to retract.

It is preferred that the barrel is made of a ceramic-plated material, allowing for better heat retention and conduction. Alternatively, the barrel may be composed of polyethylene, aluminum, ABS, carbon fiber or any other suitable material. The handle function of the preferred embodiment of the new retractable hairbrush system is specifically designed as individual curved "rods" to allow for better grip and ease of motion when the rods are collapsed into the body of the brush via the brush barrel's inner surface "track" system. The handle can be composed of any suitable material, such as stainless steel, polyethylene, aluminum, ABS, carbon fiber, high-heat resistant rubber, natural sustainable materials like bamboo, cedar wood and/or mahogany.

Figure 3:
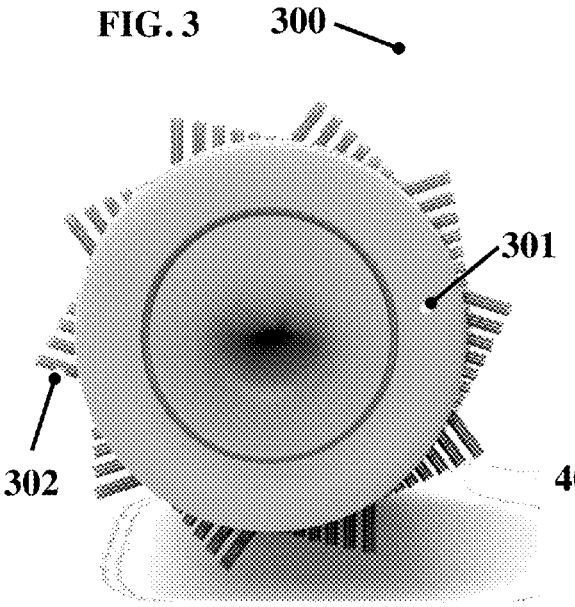
FIG. 3 depicts the top view of one embodiment of the retractable hairbrush system.

FIG. 3 illustrates the top view of one embodiment of the new retractable hairbrush system 300, showing the removable end cap 301, which can be removed to enable convenient cleaning of the brush, and bristles 302.

Figure 4:
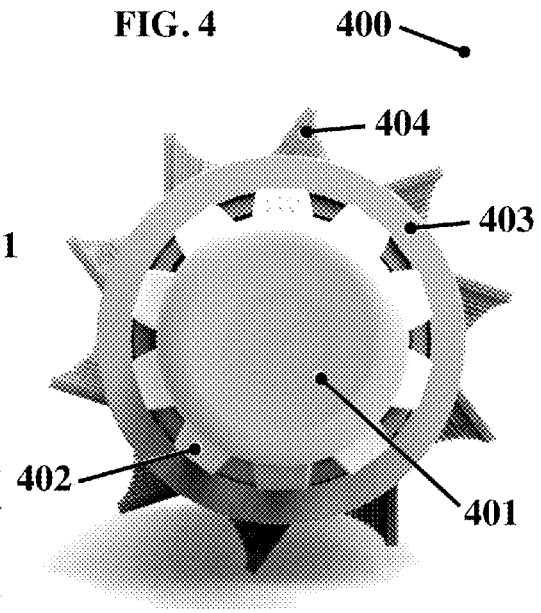
FIG. 4 depicts the bottom view of one embodiment of the retractable hairbrush system.

FIG. 4 illustrates the bottom view of one embodiment of the new retractable hairbrush system 400, showing a handle cap 401, which attaches or is placed at the attachment point of the handle rods 402. Further depicted are the bottom view of the body barrel 403 and bristles 404 attached perpendicularly to the barrel in a wave pattern.

Figure 5:
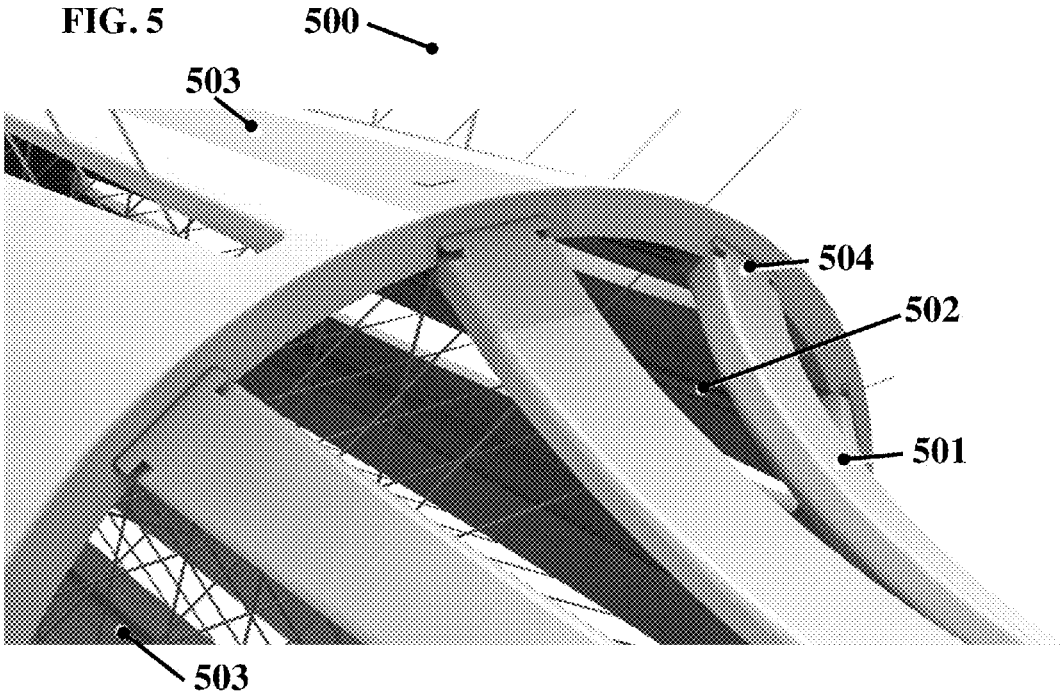
FIG. 5 depicts a close-up perspective view of one embodiment of the retractable hairbrush system where the handle and barrel meet in "brushing" position.

FIG. 5 depicts close-up perspective view of one embodiment of the retractable hairbrush system 500 where the handle and barrel meet in "brushing" position. As shown, the handle rods 501 are positioned as to be aligned with the inner barrel tracks 502 of the barrel 503 while maintaining bushing position via locked "lips" 504 that prevent sliding of the handle rods 501 along the tracks 502 until the user squeezes or otherwise causes the rods to contract and, thus, causes the lips to disengage. The new retractable brush system's primary mechanism works by retracting (collapsing) the handle into the body of the brush thereby allowing a user to place several brushes on the head in roller position without the handle impeding results. When the handle rods are squeezed, they ends are allowed to slide into the body along tracks on the inner surface of the barrel. This prevents the handle from moving until the user deliberately causes the handle to retract.

Figure 6A:
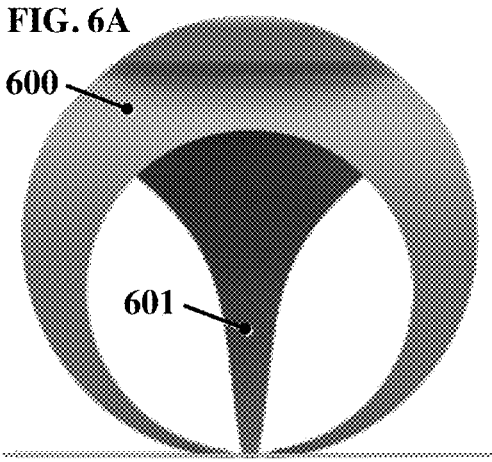
Figure 6B:
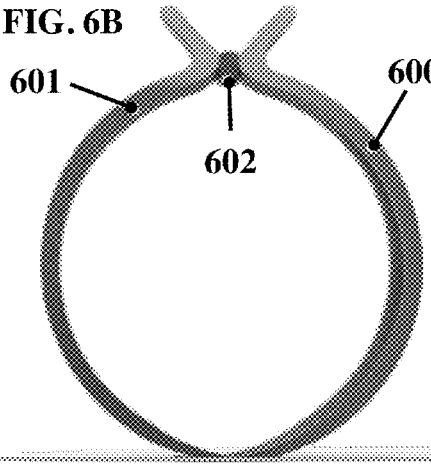
Figure 6C:
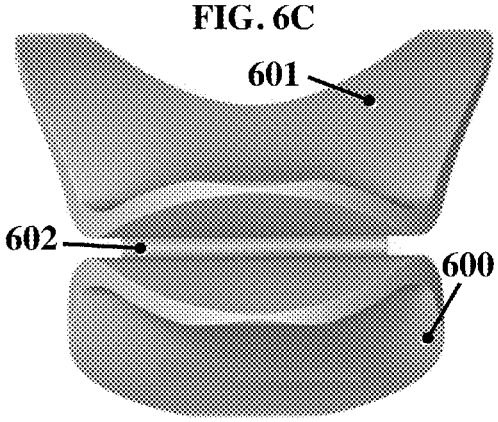
Figure 6D:
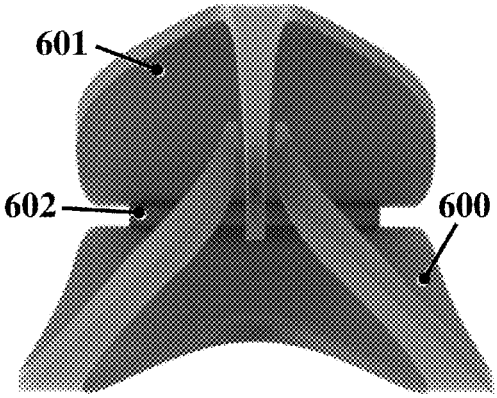
Figure 6E:
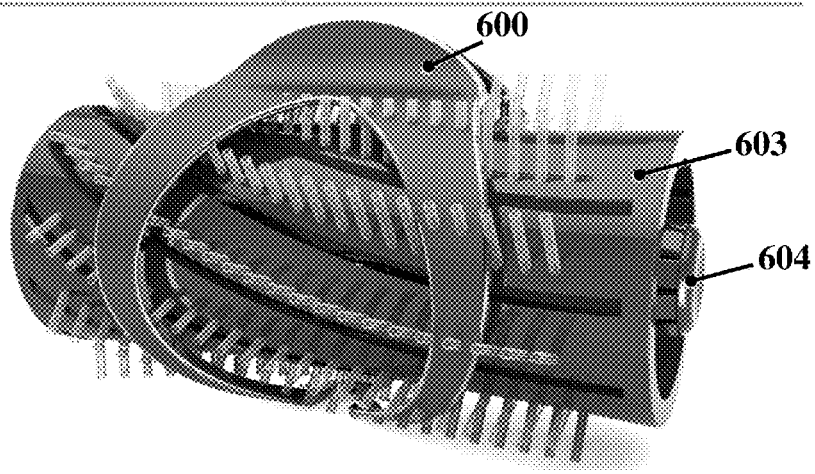

FIG. 6A-D depict the front, side, top and bottom views, respectively, of one embodiment of the wishbone clip. FIG. 6A shows the front view of first body member 600 having two prongs and the second body member 601 having one prong. FIG. 6B shows the side view of the first body member 600 connected to the second body member 601 via a connection means 602. FIG. C shows the top view of the first body member 600 connected to the second body member 601 via a connection means 602. FIG. D shows the bottom view of the first body member 600 connected to the second body member 601 via a connection means 602. FIG. 6E illustrates the perspective view of one embodiment of the wishbone clip as position on the new hairbrush system in roller position, showing the first body member 600 of the clip in working position, gripping the barrel 603 in roller position with the handle 604 fully retracted.

FIG. 6E illustrates the function of one embodiment of the wishbone clip in position, securing the hair-wrapped barrel of the retractable hairbrush in place.

FIG. 7A illustrates one embodiment of the new hairbrush system 700 having a functional storage case 701 containing six retractable hairbrushes 702, six wishbone clips 703 and a studio stand for the new hairbrush system 704. FIG. 7B shows the studio stand 704 in upright position holding six retractable hairbrushes 702. FIG. 7C show six wishbone clips 703 as positioned on a storage rod 705.

As to further discussion of the manner of usage and operation of the present invention, the same should be apparent from the above description. With respect to the above description then, it is to be realized that the optimum dimensional relationships for the parts of this invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Although the description presented heretofore contains specificities for the benefit of illustration, these should not be construed as limiting the scope of the embodiments but rather as illustrative examples of some of the several embodiments. Thus, the scope of the embodiments should be determined by the appended claims and their legal equivalents rather than by the examples provided.

The invention claimed is:

1. A hair grooming system comprising:

a brush barrel that is substantially cylindrical, having an interior and an exterior, a first end and a second end, a hollow center, bristles attached generally perpendicular to said exterior, a venting means in the brush barrel, and a complimentary sliding means in or on said interior that run generally parallel to the axis of the brush barrel;

an elongated handle, having a first end and a second end wherein said first end is proximal to said second end of said brush barrel and said second end is distal to said second end of said brush barrel, said elongated handle being substantially of a pronged style wherein said second end is relatively solid and said first end is generally pronged, enabling manual compression and dilation of the circumference of said second end;

a means for attaching the first end of said elongated handle to the second end of said brush barrel in such a position enabling the pronged features of the first end of said elongated brush barrel to align with the complimentary sliding means of said brush barrel;

a means for arresting movement of said elongated handle generally near and involving the second end of the brush barrel when the elongated handle is fully extended from said brush barrel in "brushing" position;

a sliding means enabling the pronged ends of said handle to securely slide along said complimentary sliding means; and and a means for arresting movement of said elongated handle generally near and involving the first end of the brush barrel when the handle is fully retracted into said brush barrel in "rolling" position.

2. The hair grooming system of claim 1 wherein said brush barrel is composed of any suitable heat transfer material.

3. A hair grooming system package comprising:

a hair grooming system comprising:

a brush barrel that is substantially cylindrical, having an interior and an exterior, a first end and a second end, a hollow center, bristles attached generally perpendicular to said exterior, a venting means in the brush barrel, and a complimentary sliding means in or on said interior that run generally parallel to the axis of the brush barrel;

an elongated handle, having a first end and a second end wherein said first end is proximal to said second end of said brush barrel and said second end is distal to said second end of said brush barrel, said elongated handle being substantially of a pronged style wherein said second end is relatively solid and said first end is generally pronged, enabling manual compression and dilation of the circumference of said second end;

a means for attaching the first end of said elongated handle to the second end of said brush barrel in such a position enabling the pronged features of the first end of said elongated brush barrel to align with the complimentary sliding means of said brush barrel;

a means for arresting movement of said elongated handle generally near and involving the second end of the brush barrel when the elongated handle is fully extended from said brush barrel in "brushing" position;

a sliding means enabling the pronged ends of said handle to securely slide along said complimentary sliding means; and and a means for arresting movement of said elongated handle generally near and involving the first end of the brush barrel when the handle is fully retracted into said brush barrel in "rolling" position;

a case for safe and clean storage of said multiplicity of said hair grooming system; and a removable stand for presentation and table-top storage of said hair grooming system.

* * * * *